US005191726A

United States Patent [19]

Vallee

[11] Patent Number: 5,191,726

[45] Date of Patent: Mar. 9, 1993

[54] ASYMMETRIC BALLET SHOE AND PAIR OF SUCH SHOES

[75] Inventor: Jean-Marie Vallee, Asnieres, France

[73] Assignee: Repetto, Paris, France

[21] Appl. No.: 876,860

[22] Filed: Apr. 30, 1992

[30] Foreign Application Priority Data

May 3, 1991 [FR] France ..... 91 05467

[51] Int. Cl.[5] ..... A43B 5/12

[52] U.S. Cl. ..... 36/88; 36/113; 36/8.3

[58] Field of Search ..... 36/8.3, 88, 93, 113, 36/96

[56] References Cited

U.S. PATENT DOCUMENTS

| | | | |
|---|---|---|---|
| 1,525,848 | 2/1925 | Bonaventure | 36/113 X |
| 1,744,122 | 1/1930 | Keeling | 36/8.3 |
| 1,819,766 | 8/1931 | Capezio | 36/96 X |
| 1,844,885 | 2/1932 | Harris | 36/113 X |
| 1,953,659 | 4/1934 | Savino | 36/113 X |
| 2,701,925 | 2/1955 | Luhr | 36/8.3 X |
| 3,797,137 | 3/1974 | Harkness | 36/113 |
| 4,026,046 | 5/1977 | Clark et al. | 36/113 |
| 4,412,393 | 11/1983 | Terlizzi et al. | 36/113 |
| 4,901,453 | 2/1990 | Gaynor . | |
| 5,101,579 | 4/1992 | Terlizzi et al. | 36/8.3 |

*Primary Examiner*—Jimmy G. Foster
*Assistant Examiner*—Ted Kavanaugh
*Attorney, Agent, or Firm*—Remy J. VanOphem

[57] ABSTRACT

Ballet shoe (2) comprising a sole (3, 6) to which is fixed a flexible upper (4) stiffened in a front part up to a substantially flat end (7) by a vamp (5) covered by said upper and adapted to surround the front part of the foot of a dancer, characterized in that said front part of said upper has on its upper surface a peak line (10) formed by points (M) of maximum height of transverse cross-sections of said front part of said upper which is offset to one side of a longitudinal plane (P) of the shoe, diverging from this plane in the direction away from the end (7) of the shoe, this front part of said upper being joined transversely on the other side of said longitudinal plane to an area forming a flat (13) widening in the direction away from said end, whereby said shoe is specifically intended for a respective foot of a dancer, the peak line being adapted to run along the top of the big toe of the foot in question.

6 Claims, 3 Drawing Sheets

ASYMMETRIC BALLET SHOE AND PAIR OF SUCH SHOES

BACKGROUND OF THE INVENTION

The invention concerns a ballet shoe suitable for steps executed with the weight of the body supported by the toe (for which the term of the art is the French word "pointe").

A ballet shoe primarily comprises a sole to which is joined a flexible cap or "upper", usually made from cotton or satin, which covers the front of the foot and extends on either side of the instep to run around behind the heel. The front of the upper is made rigid by a box or "vamp" adapted to surround the front part of the foot; in practise the vamp is formed of glued together layers of cotton, jute and felt, for example, which are then formed to the required shape in the front part of the upper using a shoe tree or "last": the stiffness of the vamp depends of the nature and quantity of the glue. In practise the sole comprises an outer sole of leather, for example, and an inner sole extending as far as the end of the vamp formed by a leather or cardboard insole covered with cotton fabric and an underlying stiffener plate or "shank" of cardboard, for example.

Conventional ballet shoes of this kind have enabled generations of dancers to execute the gracious "pointe" dance steps required by their art but at the cost of painful compression of the front part of the foot causing the infamous "dancer's bunion" and sometimes pathology of the bones, ligaments, muscles or tendons.

It must be remembered that in "pointe" dance steps all of the contact force with the floor passes through the front part of the foot (especially the toes) which must not deflect forwards, backwards or sideways. These forces can be extremely high and experiments have shown that under certain conditions, when executing "pointe" jumps on concrete, for example, accelerations in the order of $-10$ g can be generated in the front part of the foot. This explains the need for the vamp to support the front part of the foot very firmly if serious accidents are to be avoided.

A ballet shoe is in practise inevitably deformed from its new state of maximum stiffness as it is worn in and its stiffness deteriorates until it must be replaced; because of this, for most of the time for which it is used a shoe causes painful compression of the front part of the dancer's foot and reducing this painful period (for example by using a reduced quantity of glue) shortens the useful life of the shoe.

SUMMARY OF THE INVENTION

An object of the invention is to shorten this painful period or at least to reduce the discomfort suffered by the dancer during the life of the shoe, without reducing the latter. In other words, it is directed to a shoe which, having the same usable life as in the past, causes less discomfort without compromising the support of the front part of the foot or the safety of the dancer, at an affordable extra cost and without undue impact on the traditions or the aesthetics of the dance.

To this end the invention proposes a ballet shoe comprising a sole to which is fixed a flexible upper stiffened in a front part up to a substantially flat end by a vamp covered by said upper and adapted to surround the front part of the foot of a dancer, characterized in that said front part of said upper has on its upper surface a peak line formed by points of maximum height of transverse cross-sections of said front part of said upper which is offset to one side of a longitudinal plane of the shoe, diverging from this plane in the direction away from the end of the shoe, this front part of said upper being joined transversely on the other side of said longitudinal plane to an area forming a flat widening in the direction away from said end, whereby said shoe is specifically intended for a respective foot of a dancer, the peak line being adapted to run along the top of the big toe of the foot in question.

It will be understood that the invention introduces a difference, all be it a limited difference, between the left and right shoes, which is in itself a revolution in the world of the dance.

As implied above, in pairs of ballet shoes known until now there has been no difference between the shoes, which have been symmetrical relative to the aforementioned longitudinal plane, produced using identical lasts (shoe trees) and paired so as to have in practise the same shade of upper and comparable stiffness (it should be remembered that these shoes are essentially handcrafted, so that there are inevitably slight differences from one shoe to the next).

Surprising as this may seem, the inventors are unaware of any prior proposal for there to be any difference whatsoever between the shoes of a pair when new.

For leading dancers the concern to minimize their discomfort has been limited to the production for each dancer of a customized but symmetrical last. Attempts have also been made to reduce the risk of pathology to the feet of dancers, for example by the document PCT/FR89/00555 disclosing the use of new materials, but without introducing any difference between the left and right shoes.

There are many possible reasons for this state of affairs.

First of all, it has been very widely accepted in the world of the dance that the compression of the front part of a dancer's foot by her shoes guarantees proper support of this part of the foot when executing "pointe" dance steps: in other words, the painful nature of this compression was a necessary evil. A difference between the shoes arises with use, but it has seemed essential that this should be brought about by the actual feet of the dancer, who is the only person to wear the shoes until they are completely worn out.

What is more, a difference like the difference between the left and right shoes of an everyday pair of shoes has seemed of no benefit and even hazardous.

Note that ballet shoes are reserved to a restricted clientele, given the nature of their art, and have an entirely different function to street shoes, leisure shoes or indoor shoes worn by the general public in everyday life: the ballet shoes to which the invention is directed are primarily intended, as explained above, for executing "pointe" dance steps whereas everyday shoes or slippers are designed primarily for the foot resting flat on the ground (walking, running or even jumping . . . ).

The asymmetry at the instep and the heel of everyday shoes and slippers is in no way required in the dance because the symmetrical upper of ballet shoes, given its flexibility, naturally molds itself to the sole of the foot and the sole of the shoe, whose function is to support the arch of the foot along part only of whose width and length it runs, fulfils this function much more through its stiffness than through its shape.

What is more, the invention does not require any differentiation in regard of the upper or the sole (although it does not exclude this).

As for the asymmetry at the front of everyday shoes and slippers, producing a more or less accentuated point offset towards the big toe and with an outside lateral edge more inclined as seen from above than the inside lateral edge relative to the axis of the foot, this contradicts the requirement in the dance to provide for the curved foot wearing a ballet shoe an area of support on the floor of maximum surface area and, most importantly, centered on the axis of the foot or even of the leg; to a first approximation, this would require that the vamp were symmetrical.

It is furthermore undeniable that the symmetry of ballet shoes makes a significant contribution to their aesthetics, an essential characteristic in any art, and therefore in the dance.

Finally, the economics of ballet shoe manufacture would argue against introducing any difference between the shoes of a pair given the ensuing complications, failing excellent reasons for doing so, which have previously seemed to be wanting.

Additionally, tradition in the dance is extremely important to the point where any innovations concerning geometry and materials (the requirement for natural materials) used for the various component parts of the shoe are a priori suspect.

The invention recognizes the critical place in a ballet shoe where a difference between the right foot and the left foot is important from the point of view of the dancer's comfort without compromising the proper distribution of forces in the foot which would nevertheless, at first sight, argue in favor of symmetry, the difference being sufficiently discreet to respect the aesthetics of the shoe and the traditions of the dance.

To this end the invention has moved away from the prior art reasoning which sees the shoe from above or from below to adopt reasoning based on the end view.

Accordingly to possibly combinable preferred features of the invention:

starting from said end of the shoe, the peak line diverges from the longitudinal plane at an angle of 5° to 15° as seen from above, the angle of divergence as seen from above is between 5° and 10°, said peak line is at least approximately straight as seen from the side, said peak line is at an angle of approximately 20° to 25° to the base of the vamp as seen from the side.

The invention further proposes a pair of ballet shoes of the above-defined type comprising two shoes in which the peak lines are offset in opposite directions relative to the respective longitudinal planes of said shoes.

BRIEF DESCRIPTION OF THE DRAWINGS

Objects, features and advantages of the invention will emerge from the following description given by way of non-limiting example only with reference to the appended drawings in which.

DESCRIPTION OF THE PREFERRED EMBODIMENT(S)

Figure 1:
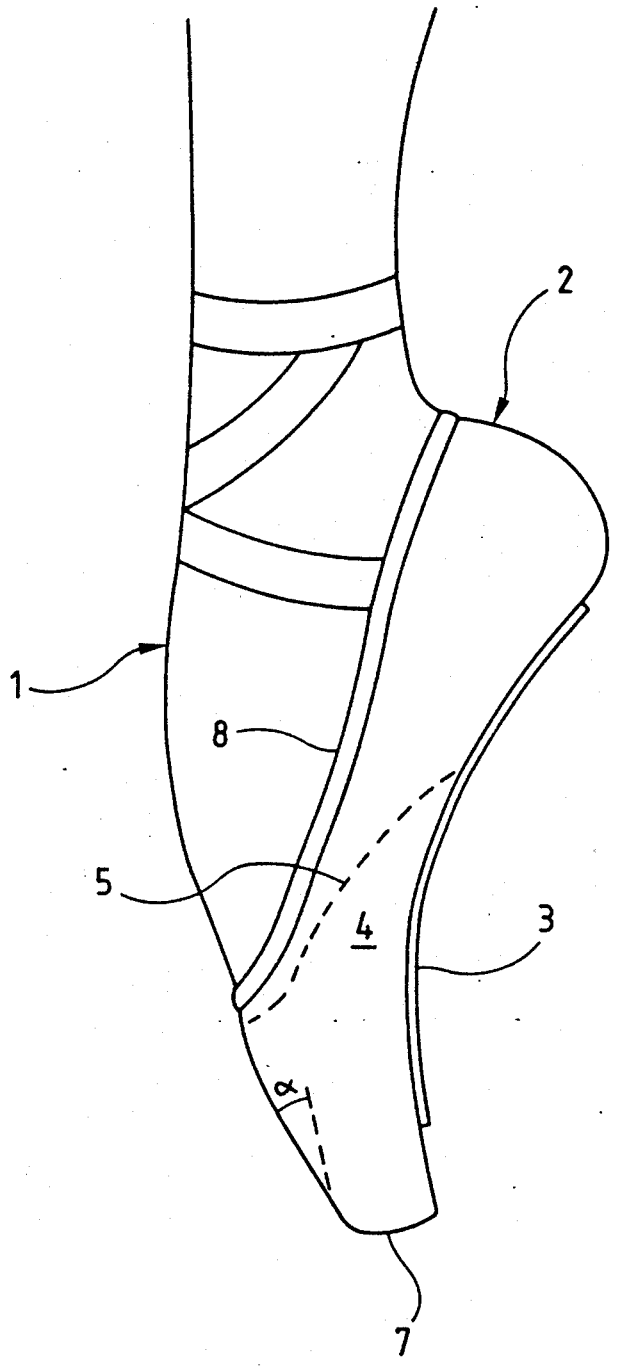
FIG. 1 is a side view of a foot in the "pointe" position wearing a right shoe in accordance with the invention.

FIG. 1 shows the right foot 1 of a dancer executing a "pointe" dance step; the foot is wearing a ballet shoe shown in FIGS. 1 through 4 and comprising in the known way an outer sole 3 to which is joined a flexible upper 4 covering the toes and more generally the front part of the foot of the dancer and extending along either side of the instep and around the heel. Inside the upper is a vamp 5 shown in dashed outline in FIG. 1 whose stiffness firmly supports the front part of the dancer's foot. An insole 6 is fixed to the inside of the upper and extends as far as the end of the vamp; an intermediate piece or shank 6A (see FIG. 4) which stiffens the shoe longitudinally is sandwiched between the outer sole 3 and the insole 6. The front part 7 of the shoe, called the point, is generally flat, but very slightly convex.

The upper 4 is conventionally of satin, the outer sole 3 of leather, the insole 6 and the shank 6A of strong cardboard and the vamp is formed by a layer of jute, a piece of felt, a layer of jute and a layer of cotton fabric bonded together and held in shape by being impregnated with glue. It should be understood that the above explanations, conventional in themselves, are given by way of non-limiting example only.

Figure 2:
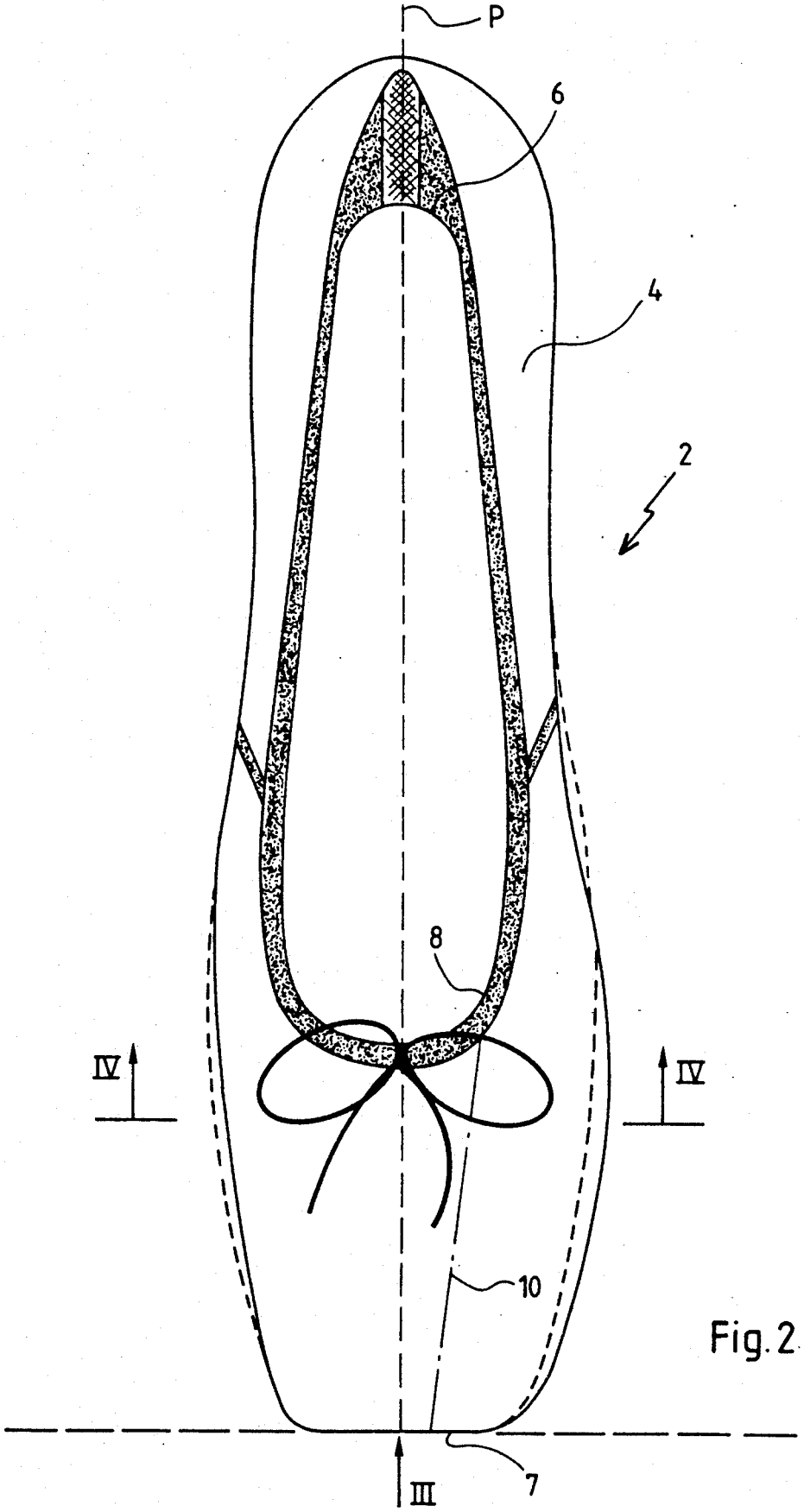
FIG. 2 is a top view of this shoe with the outline of a conventional shoe shown in dashed line.
Figure 3:
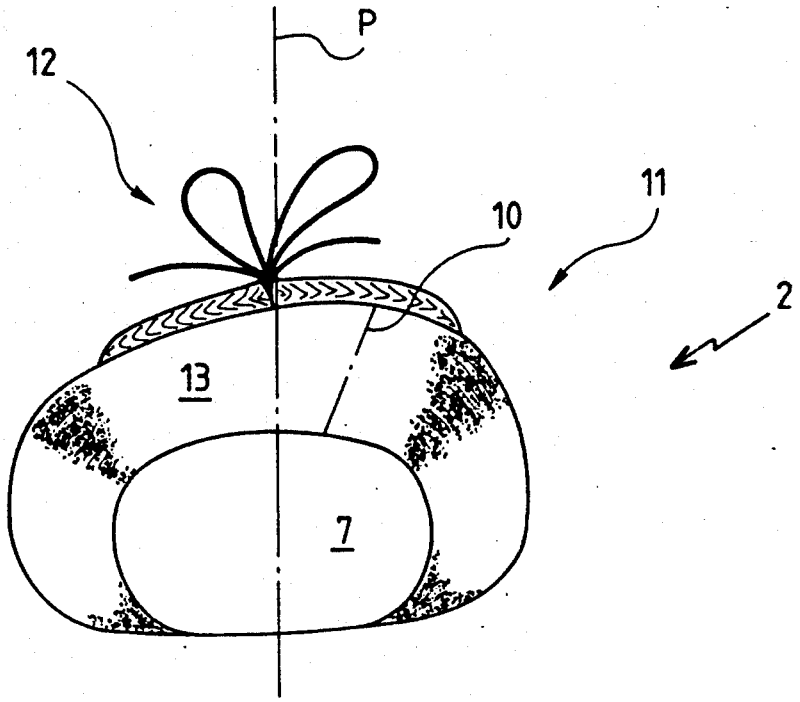
FIG. 3 is an end view of the shoe as seen in the direction of the arrow III in FIG. 2.

According to the invention, the ballet shoe 2 is asymmetrical relative to the longitudinal plane P of FIG. 2. This lack of symmetry is seen most clearly in FIGS. 3 and 4 in the shape of the vamp and therefore of the shoe over the top of the foot.

Figure 4:
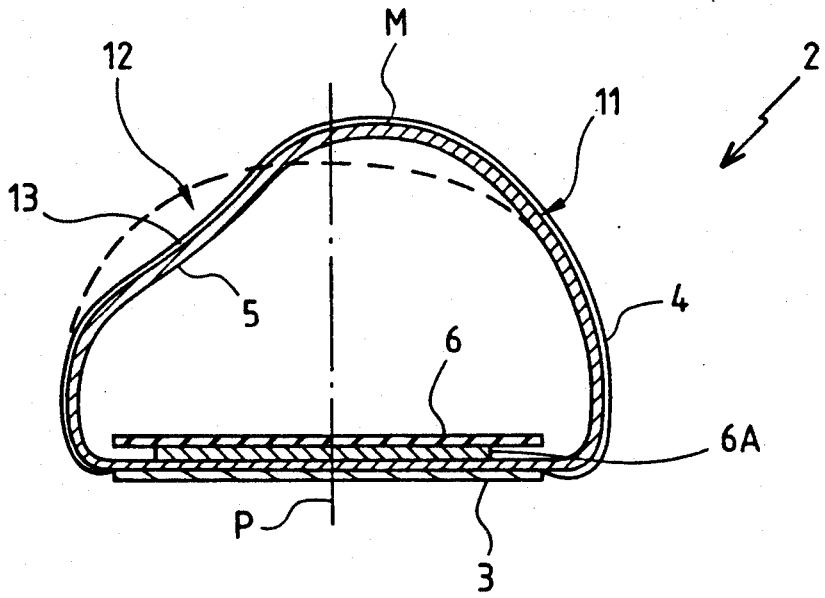
FIG. 4 is a view of the shoe in cross-section on the line IV—IV in FIG. 2 showing the profile of a conventional shoe in dashed outline.

Unlike conventional shoes whose shape over the front part of the foot is shown dashed outline in FIG. 4, the shoe 2 has a maximum height at a point M which is offset laterally from the longitudinal plane P on the side towards the big toe. As is clear from FIGS. 2 and 3, the set of points M in consecutive transverse cross-sections of the vamp forms a peak line 10. This line is offset from the plane P by a distance averaging only a few millimeters, from around 5 mm near the point 7 of the shoe (where this line is hardly discernible) up to approximately 12 mm near the border 8 of the upper. Thus starting from the point this peak line moves away from the plane at an angle of approximately 7° to 8° as seen from above (preferably between 5° and 15° and advantageously between 5° and 10°, depending on the size and the width of the shoe).

The offset of the peak line in a cross-section plane is seen to be about 0.5 to 1.5 times (in this instance about 0.10 times on average) the width of the shoe in the section plane.

Seen from the side (FIG. 1), the peak line is practically straight and is at an approximately constant angle $\alpha$ to the bottom (or base) of the vamp, in this instance an angle of around 20° to 25°.

Of course, this peak line is hardly discernible, all of the half 11 of the top of the shoe having to cover the big toe and part (the inside half) of the metatarsal having a slowly varying curvature.

On the other hand, the other half 12 (the outside half) comprises a flat 13 that becomes wider and more marked in the direction away from the point of the shoe until, in this example, it assumes a slightly concave shape (see FIG. 4).

FIG. 1 shows for comparison and in dashed outline the contour as seen from above of a conventional shoe. It shows that the difference in the shoe 1 as seen from above is very slight and makes only a very slight difference to the aesthetics of the shoe; in fact, the difference has been exaggerated to make it visible but is very difficult to discern on looking at a real shoe, being much less clearly visible than the asymmetry of the top of the vamp. The difference consists in a widening along the big toe followed by a narrowing on approaching the instep and, on the other side, a narrowing along the little toe.

In fact, this difference between the flanks of the vamp is advantageous but not indispensable; surprisingly, the improved comfort of a dancer wearing the shoe 2, both at the end of the big toe and along the sides of the foot, appears to result primarily from the asymmetry of the upper part of the vamp.

It will be understood that the invention introduces only a limited amount of asymmetry and therefore requires very little modification to the method of manufacturing the shoes, the principle of which has outlined at the beginning of this description: it is sufficient to modify the shoe trees which impart the shape while the glue is drying, everything else remaining unchanged relative to the conventional manufacturing steps:

preparation of a symmetrical upper fixed to a symmetrical outer sole, stacking and gluing possibly symmetrical layers of jute, felt, jute and cotton then forcing them fully home into the front part of the upper, when the glue has hardened, fixing a symmetrical insole extending to the end of the vamp and a symmetrical shank.

Of course, the invention does not exclude any further difference between these components but these would additionally increase the comfort of the dancer without being the main reason for the improvement.

A shoe for the left foot (not shown) has the same features as the shoe 2 but with the halves 11 and 12 transposed with respect to the longitudinal plane.

The right and left shoes of a pair are different from each other but symmetrical to each other.

It goes without saying that the foregoing description has been given by way of non-limiting example only and that numerous variations thereon may be put forward by the man skilled in the art without departing from the scope of the invention.

There is claimed:

1. Ballet shoe comprising a sole to which is fixed a flexible upper stiffened in a front part up to a substantially flat end, by a vamp covered by said upper and adapted to surround the front part of the foot of a dancer wherein said front part of said upper has on its upper surface a peak line formed by points of maximum height of transverse cross-sections of said front part of said upper which is offset to one side of a longitudinal plane of the shoe, diverging from this plane in the direction away from the end of the shoe, said front part of said upper being joined transversely on the other side of said longitudinal plane to an area forming a flat widening in the direction away from said end, whereby said shoe is specifically intended for a respective foot of a dancer, said peak line being adapted to run along the top of the big toe of the foot in question.

2. Ballet shoe according to claim 1 wherein, starting from said end of said shoe, said peak line diverges from said longitudinal plane at an angle of 5° to 15° as seen from above.

3. Ballet shoe according to claim 2 wherein the angle of divergence as seen from above is between 5° and 10°.

4. Ballet shoe according to claim 1 wherein said peak line is at least approximately straight as seen from the side.

5. Ballet shoe according to claim 4 wherein said peak line is at an angle of approximately 20° to 25° to the base of said vamp as seen from the side.

6. Pair of ballet shoes comprising two shoes each of which comprises a sole to which is fixed a flexible upper stiffened in a front part up to a substantially flat end by a vamp covered by said upper and adapted to surround the front part of the foot of a dancer, wherein said front part of said upper has on its upper surface a peak line formed by points of maximum height of transverse cross-sections of said front part of said upper which is offset to one side of a longitudinal plane of the shoe, diverging from this plane in the direction away from the end of the shoe, said front part of said upper being joined transversely on the other side of said longitudinal plane to an area forming a flat widening in the direction away from said end, whereby said shoe is specifically intended for a respective foot of a dancer, said peak line being adapted to run along the top of the big toe of the foot in question, in which pair of shoes said peak lines are offset in opposite directions relative to the respective longitudinal planes of said shoes.

* * * * *